United States Patent [19]

Battista

[11] 4,358,292

[45] Nov. 9, 1982

[54] STABILIZED HYBRID FUEL SLURRIES

[76] Inventor: Orlando A. Battista, Fort Worth, Tex.

[21] Appl. No.: 67,387

[22] Filed: Aug. 17, 1979

[51] Int. Cl.[3] ..... C10L 1/32

[52] U.S. Cl. ..... 44/51

[58] Field of Search ..... 44/51

[56] References Cited

U.S. PATENT DOCUMENTS

| | | | |
|---|---|---|---|
| 1,431,225 | 10/1922 | Greenstreet | 44/51 |
| 1,647,471 | 11/1927 | Plauson et al. | 44/51 |
| 2,090,393 | 8/1937 | Roberts | 44/51 |
| 2,118,337 | 5/1938 | Roberts . | |
| 2,231,513 | 2/1941 | Stillman | 44/51 |
| 4,090,853 | 5/1978 | Clayfield et al. | 44/51 |
| 4,145,188 | 3/1979 | Espenscheid et al. | 44/51 |

*Primary Examiner*—Charles F. Warren
*Assistant Examiner*—Y. Harris-Smith
*Attorney, Agent, or Firm*—George F. Mueller

[57] ABSTRACT

A method of preparing new compositions of stabilized suspensoids of hybrid fuel oils comprising varying mixtures of ultrafine coal, virus-size pure carbon particles, finely ground newsprint and sawdust. The resultant stabilized fuel slurries are mixed mechanically to produce pumpable new forms of fuels whereby conventionally available petroleum fuel oils can be extended.

The slurry is injected through lances into a blast furnace; the lances may provide concentric streams of slurry and steam. The slurry may also be used in other fuel burning furnaces such as boilers, cement kilns, etc.

14 Claims, No Drawings

STABILIZED HYBRID FUEL SLURRIES

SUMMARY OF THE INVENTION

This invention relates to novel stabilized hybrid fuel slurries and the method of preparing same, and more particularly to the method of preparing stabilized hybrid fuel slurries comprising mixtures having varying compositions of finely ground coal, particles of carbon black less than one micron, finely ground newsprint, sawdusts, cellulose, clean organic energy-rich waste materials, and submicron microcrystals isolated from organic polymers.

It is a principal object of the present invention to provide pumpable, stabilized hybrid fuel suspensoids comprising the use of novel emulsifiers capable of forming such stable fuel suspensoids present in the range of from about 0.1% by weight to about 10% by weight of the slurry, water present in the range of from about 1% by weight of about 30% by weight of the slurry, liquid fuel oil present in the range of from about 30% by weight to about 70% by weight of the slurry, and solid fuel particles with diameters as large as about ⅛ inch dispersed in the emulsion and present in the range of from about 25% by weight of about 65% by weight of the slurry.

Another object of the present invention is to provide a stabilized fuel slurry for injection into blast furnaces preferably with steam atomization.

Another object of the present invention is to provide a stabilized fuel slurry for burning in boilers. For example, the boilers may be integrated in a common fuel supply system with blast furnaces or they may be completely separate.

This invention relates to a method of preparing a hybrid fuel suspensoid in which novel suspending or emulsifying agents are used to produce stable mixtures having varying combinations of low-cost finely ground coal (less than ⅛ inch), particulate carbon black with particles less than one micron, finely ground newsprint, sawdust, cellulose, clean organic energy-rich waste materials, and submicron microcrystals isolated from linear organic polymers.

It is a principal object of the present invention to provide stable hybrid fuel suspensoids described above capable of being stored in line for as long as many weeks without solidfying and clogging the lines.

Another object of the present invention is to provide a stabilized fuel slurry for injection into blast furnaces preferably with steam atomization.

Another object of the present invention is to provide a stabilized fuel slurry for burning in boilers which may be integrated in a common fuel supply system with blast furnaces or they may be completely separate. Use of the stabilized fuel slurry, however, is not limited to use in blast furnaces or boilers but may be utilized in other fuel burning devices.

Yet another object of the present invention is to provide a method of producing stable hybrid fuel suspensoids containing combustible submicron particles capable of emulsifying and stabilizing such suspensoids, said inexpensive submicron particles being present in the range of about 0.1% by weight to about 10% by weight of the slurry, water present in the range of from about 1% by weight to about 30% by weight of the slurry, liquid fuel oil present in the range of from about 30% by weight to about 70% by weight of the slurry, and solid fuel particles with diameters as large as about ⅛ inch dispersed in the emulsion and present in the range of from about 25% by weight to about 65% by weight of the slurry to form a slurry stable for a period of time in excess of one month.

Processes which use expensive or hard to obtain emulsifiers are uneconomical or so burdensome as to be useless. Processes which produce a slurry difficult to pump or a slurry with a tendency to settle after a few days, are simply commercially not useful. These and other disadvantages are obviated by the present invention using an inexpensive emulsifier to produce an extremely stable slurry, thereby permitting extensive industrial use of the present invention.

BACKGROUND OF THE INVENTION

Suspensions of coal and coal by-products in fuel oil have been proposed as a fuel for blast furnaces, boilers and other fuel burning devices, but because of the danger and difficulty in handling and maintaining the suspensions over long periods of time, no practical system has yet been devised for the large scale use of this combination fuel. Methods have been proposed that require the use of an expensive emulsifier, which severely reduce the economic benefits of the system.

U.S. Pat. No. 2,118,477, issued May 24, 1938 to Roberts teaches the combination of colloidal coal particles and oil to form a suspension for use as a composite fuel. The difficulty, expense, and hazards in grinding coal to colloidal fineness, such that it passes through a 300 to 1,000 mesh sieve, has prevented the composition fuel disclosed by Roberts from being used in present day furnaces.

U.S. Pat. No. 2,231,513, issued Feb. 11, 1943 to Stillman, teaches a stable suspension of coal and oil made by pre-grinding coal particles until they pass through a 100-mesh screen and thereafter introducing the pre-ground particles into oil and subjecting the combination to a further grinding until the particle size is reduced to about 5 microns. All of the coal particles are small enough to pass through a 325-mesh screen, and at least 50% of the particles are under 10 microns in size, which is sufficient for the particles to produce the phenomenon known as the "Brownian Movement". The "Brownian Movement" of the particles is sufficient to maintain all of the coal particles in stable suspension, in lieu of starch, since starch forms a "gel" with a disadvantageously high viscosity making preheating and pumping the slurry difficult.

Other parent, such as the Plauson et al. U.S. Pat. No. 1,647,471, issued Nov. 1, 1927, teach the combination of pre-ground carbonaceous material with an oil. The Plauson et al. patent teaches pre-grinding the carbonaceous material to a powder which passes through a 125 to 250-mesh screen, and, thereafter, forming an emulsion with the oil by the addition of from about 1% to about 3% of a soap solution. The Plauson et al. patent has an additional disadvantage besides the small particle size of the carbonaceous material as the suspension or emulsion is produced in small batches using a cross hammer mill rotating at 325 feet per minute.

U.S. Pat. No. 2,090,393, issued Aug. 17, 1937 to A. A. Roberts, teaches the use of a minor amount of starch in the order of 150 of 1%, mixed with water and an electrolyte such as a boron compound. The fundamental thrust of the patent is to improve combustion, not to produce a slurry stable for several weeks. The specific problems to which the present invention is directed are not discussed in the Roberts patent.

DESCRIPTION OF THE PREFERRED EMBODIMENTS

The combination hybrid fuels of the present invention include the use of organic (combustible) particulate (insoluble) colloidal emulsifiers comprising relatively low concentrations of submicron particles of pure carbon of graphite, and aqueous suspensions of microcrystals isolated from linear organic polymers as described by Battista in the McGraw-Hill (1975) textbook "Microcrystal Polymer Science".

The hybrid fuels of the present invention include as major components a liquid fuel oil which preferably is a petroleum product or coal product and includes a crank case oil, crude oil, various fuel oils such as No. 6 fuel oil, raw coal tar and any other type of combustible oil. The combination fuel of the present invention also includes a solid fuel which may be any carbonaceous fuel such as coal, coke breeze, petroleum coke or residuum or any other solid combustible material.

In general, the slurry hybrid-fuels of the present invention are produced in batch operations wherein the aqueous suspensions of organic particulate (insoluble) particles or crystals are mixed in using high speed shearing equipment—similar to a Waring Blendor. Subsequently, "run of the mine" coal or other solid carbonaceous fuel is added. The object of the use of high speed rotational stirring is to produce an intimate and stable mixture of the various ingredients. Of importance, of course, is that the resulting slurry is stabilized such that storage over relatively long periods of time such as a month or more, results in little separation of the oil and the solid particles dispersed therein or of the water.

The stabilized slurry is not thixotropic and is pumpable as a normal liquid, the limitation in solid particle size being determined by the pumping apparatus. The stabilized slurry is then introduced into a blast furnace, preferably with steam, or may be introduced into any direct fired heater, furnace or boiler.

The advantages of the present invention reside in the use of novel, inexpensive, insoluble (particulate) submicron colloidal particles or polymer microcrystals to produce hybrid fuel slurries that are substantially stable for a period of time in excess of one month. Some settling may occur but the slurry must remain pumpable without prolonged agitation to be useful.

EXAMPLE 1

A laboratory Waring Blendor was charged with 225 grams of No. 6 fuel oil at a temperature of 140° F., 25 grams of a 10% aqueous suspension of submicron carbon black particles (average particle size about 500 Angstroms) was added to the fuel oil while it was being vigorously stirred. As the mixture was being stirred, 200 grams of finely divided anthracite coal having all particles less than ⅛ inch in size was added. Vigorous stirring was next continued for at least 10 minutes, with the temperature being retained at a minimum of 140° F. The resulting hybrid slurry was placed in Pyrex jars, and stored in an oven at 140° F. to keep viscosity much lower than what it would be at room temperature so that the stability of the mixture could be more severely tested. At the end of 20 days no settling was observed, with little or no evidence of settling appearing after 30 days.

Energy present in the major component raw materials was measured using a standard method for measuring energy as BTUs/lb, and the following results were obtained:

The No. 6 fuel oil used had an API specific gravity of 11.5, a SSF viscosity at 122° F. of 254, a sulfur content of 0.85% by weight, an ash content of 0.034% by weight and a rating of about 17,000 BTUs/lb.

The finely ground anthracite coal had an ash content of 6.0% by weight (dry basis) and a sulfur content of 1.2% by weight (dry basis), and a rating of about 15,000 BTUs/lb. All of the coal was fine - ⅛ inch in maximum size.

The stable hybrid fuel mixture had a rating of about 16,200 BTUs/lb.

EXAMPLE 2

A laboratory Waring Blendor was charged with 225 grams of No. 6 fuel oil at a temperature of 140° F., 12.5 grams of 10% aqueous suspension of submicron carbon black particles (average particle size about 500 Angstroms) plus 12.5 grams of a 10% aqueous suspensoid of cellulose microcrystals was added to the fuel oil while it was being vigorously stirred. As the mixture was being stirred, 200 grams of finely divided anthracite coal having all particles less than ⅛ inch in size was added. Vigorous stirring was next continued for at least 10 minutes, with the temperature being retained at a minimum of 140° F. The resulting hybrid slurry was placed in Pyrex jars, and stored in an oven at 140° F. to keep viscosity much lower than what it would be at room temperature so that the stability of the mixture would be more severely tested. At the end of 20 days no settling was observed, with little or no evidence of settling appearing after 30 days.

Energy present in the major component raw materials was measured using a standard method for measuring energy as BTUs/lb, and the following results were obtained:

The No. 6 fuel oil and the finely ground anthracite coal had the same respective specifications as described in Example 1.

The stable hybrid fuel mixture had a rating of about 16,000 BTUs/lb.

EXAMPLE 3

A laboratory Waring Blendor was charged with 225 grams of No. 6 fuel oil at a temperature of 140° F., 25 grams of a 10% aqueous suspension of submicron cellulose microcrystals (average particle size about 2500 Angstroms) was added to the fuel oil while it was being vigorously stirred. As the mixture was being stirred, 200 grams of finely divided anthracite coal having all particles less than ⅛ inch in size was added. Vigorous stirring was next continued for at least 10 minutes, with the temperature being retained at a minimum of 140° F. The resulting hybrid slurry was placed in Pyrex jars, and stored in an oven at 140° F. to keep viscosity much lower than what it would be at room temperature so that the stability of the mixture would be more severely tested. At the end of 20 days no settling was observed, with little or no evidence of settling appearing after 30 days.

Energy present in the major component raw materials was measured using a standard method for measuring energy as BTUs/lb, and the following results were obtained:

The No. 6 fuel oil and the finely ground anthracite coal had the same respective specifications as described in Example 1.

The stable hybrid fuel mixture has a rating of about 15,900 BTUs/lb.

EXAMPLE 4

A laboratory Waring Blendor was charged with 225 grams of No. 6 fuel oil at a temperature of 140° F., 25 grams of a 10% aqueous suspension of submicron polyamide microcrystals (average particle size about 300 Angstroms) was added to the fuel oil while it was being vigorously stirred. As the mixture was being stirred, 200 grams of finely divided anthracite coal having all particles less than ⅛ inch in size was added. Vigorous stirring was next continued for at least 10 minutes, with the temperature being retained at a minimum of 140° F. The resulting hybrid slurry was placed in Pyrex jars, and stored in an oven at 140° F. to keep viscosity much lower than what it would be at room temperature so that the stability of the mixture would be more severely tested. At the end of 20 days no settling was observed, with little or no evidence of settling appearing after 30 days.

Energy present in the major component raw materials was measured using a standard method for measuring energy as BTUs/lb, and the following results were obtained:

The No. 6 fuel oil and the finely ground anthracite coal had the same respective specifications as described in Example 1.

The stable hybrid fuel mixture had a rating of about 16,000 BTUs/lb.

EXAMPLE 5

A laboratory Waring Blendor was charged with 225 grams of No. 6 fuel oil at a temperature of 140° F., 25 grams of a 10% aqueous suspension of submicron amylose starch microcrystals (average particle size about 2000 Angstroms) was added to the fuel oil while it was being vigorously stirred. As the mixture was being stirred, 200 grams of finely divided anthracite coal having all particles less than ⅛ inch in size was added. Vigorous stirring was next continued for at least 10 minutes, with the temperature being retained at a minimum of 140° F. The resulting hybrid slurry was placed in Pyrex jars, and stored in an oven at 140° F. to keep viscosity much lower than what it would be at room temperature so that the stability of the mixture would be more severely tested. At the end of 20 days no settling was observed, with little or no evidence of settling appearing after 30 days.

Energy present in the major component raw materials was measured using a standard method for measuring energy as BTUs/lb, and the following results were obtained:

The No. 6 fuel oil and the finely ground anthracite coal had the same respective specifications as described in Example 1.

The stable hybrid fuel mixture had a rating of about 16,000 BTUs/lb.

EXAMPLE 6

A laboratory Waring Blendor was charged with 225 grams of No. 6 fuel oil at a temperature of 140° F., 25 grams of a 10% aqueous suspension of submicron polyester microcrystals (average particle size about 300 Angstroms) was added to the fuel oil while it was being vigorously stirred. As the mixture was being stirred, 200 grams of finely divided anthracite coal having all particles less than ⅛ inch in size was added. Vigorous stirring was next continued for at least 10 minutes, with the temperature being retained at a minimum of 140° F. The resulting hybrid slurry was placed in Pyrex jars, and stored in an oven at 140° F. to keep viscosity much lower than what it would be at room temperature so that the stability of the mixture would be more severely tested. At the end of 20 days no settling was observed, with little or no evidence of settling appearing after 30 days.

Energy present in the major component raw materials was measured using a standard method for measuring energy as BTUs/lb, and the following results were obtained:

The No. 6 fuel oil and the finely ground anthracite coal had the same respective specifications as described in Example 1.

The stable hybrid fuel mixture had a rating of about 16,000 BTUs/lb.

EXAMPLE 7

A laboratory Waring Blendor was charged with 275 grams of No. 6 fuel oil at a temperature of 140° F., 25 grams of a 10% aqueous suspension of submicron carbon black particles (average particle size about 500 Angstroms) was added to the fuel oil while it was being vigorously stirred. As the mixture was being stirred, 175 grams of finely divided and compressed newsprint having all particles less than ¼ inch in size was added. Vigorous stirring was next continued for at least 10 minutes, with the temperature being retained at a minimum of 140° F. The resulting hybrid slurry was placed in Pyrex jars, and stored in an oven at 140° F. to keep viscosity much lower than what it would be at room temperature so that the stability of the mixture would be more severely tested. At the end of 20 days no settling was observed, with little or no evidence of settling appearing after 30 days.

Energy present in the major component raw materials was measured using a standard method for measuring energy as BTUs/lb, and the following results were obtained:

The No. 6 fuel oil used had an API specific gravity of 11.5, a SSF viscosity at 122° F. of 254, a sulfur content of 0.85% by weight, an ash content of 0.034% by weight and a rating of about 17,000 BTUs/lb.

The finely ground compressed newsprint had an energy rating of about 7800 BTUs/lb.

The stable hybrid fuel mixture had a rating of about 14,000 BTUs/lb.

EXAMPLE 8

A laboratory Waring Blendor was charged with 275 grams of No. 6 fuel oil at a temperature of 140° F., 25 grams of a 10% aqueous suspension of submicron carbon black particles (average particle size about 500 Angstroms) was added to the fuel oil while it was being vigorously stirred. As the mixture was being stirred, 175 grams of finely divided ground wood having all particles less than ⅛ inch in size was added. Vigorous stirring was next continued for at least 10 minutes, with the temperature being retained at a minimum of 140° F. The resulting hybrid slurry was placed in Pyrex jars, and stored in an oven at 140° F. to keep viscosity much lower than what it would be at room temperature so that the stability of the mixture would be more severely tested. At the end of 20 days no settling was observed, with little or no evidence of settling appearing after 30 days.

Energy present in the major component raw materials was measured using a standard method for measuring energy as BTUs/lb, and the following results were obtained:

The No. 6 fuel oil used had an API specific gravity of 11.5, a SSF viscosity at 122° F. of 254, a sulfur content of 0.85% by weight, an ash content of 0.034% by weight and a rating of about 17,000 BTUs/lb.

The finely divided ground wood had an energy rating of about 7,500 BTUs/lb.

The stable hybrid fuel mixture had a rating of about 14,000 BTUs/lb.

EXAMPLE 9

A laboratory Waring Blendor was charged with 250 grams of No. 6 fuel oil at a temperature of 140° F., 25 grams of a 10% aqueous suspension of submicron carbon black particles (average particle size about 500 Angstroms) was added to the fuel oil while it was being vigorously stirred. As the mixture was being stirred, 175 grams of finely divided dried cellulose microcrystals having all particles less than ⅛ inch in size was added. Vigorous stirring was next continued for at least 10 minutes, with the temperature being retained at a minimum of 140° F. The resulting hybrid slurry was placed in Pyrex jars, and stored in an oven at 140° F. to keep viscosity much lower than what it would be at room temperature so that the stability of the mixture would be more severely tested. At the end of 20 days no settling was observed, with little or no evidence of settling appearing after 30 days.

Energy present in the major component raw materials was measured using a standard method for measuring energy as BTUs/lb, and the following results were obtained:

The No. 6 fuel oil used had an API specific gravity of 11.5, a SSF viscosity at 122° F. of 254, a sulfur content of 0.85% by weight, an ash content of 0.034% by weight and a rating of about 17,000 BTUs/lb.

The dry cellulose microcrystals has an energy rating of about 8,000 BTUs/lb.

The stable hybrid fuel mixture has a rating of about 14,000 BTUs/lb.

EXAMPLE 10

A laboratory Waring Blendor was charged with 275 grams of No. 6 fuel oil at a temperature of 140° F., 25 grams of a 10% aqueous suspension of submicron carbon black particles (average particle size about 500 Angstroms) was added to the fuel oil while it was being vigorously stirred. As the mixture was being stirred, 175 grams of finely divided waste cotton fibers having all particles less than ⅛ inch in size was added. Vigorous stirring was next continued for at least 10 minutes, with the temperature being retained at a minimum of 140° F. The resulting hybrid slurry was placed in Pyrex jars, and stored in an oven at 140° F. to keep viscosity much lower than what it would be at room temperature so that the stability of the mixture would be more severely tested. At the end of 20 days no settling was observed, with little or no evidence of settling appearing after 30 days.

Energy present in the major component raw materials was measured using a standard method for measuring energy as BTUs/lb, and the following results were obtaned:

The No. 6 fuel oil used had an API specific gravity of 11.5, a SSF viscosity at 122° F. of 254, a sulfur content of 0.85% by weight, an ash content of 0.034% by weight and a rating of about 17,000 BTUs/lb.

The finely ground waste cotton particles had a rating of about 8,000 BTUs/lb.

The stable hybrid fuel mixture had a rating of about 12,500 BTUs/lb.

EXAMPLE 11

A laboratory Waring Blendor was charged with 225 grams of No. 6 fuel oil at a temperature of 140° F., 25 grams of a 10% aqueous suspension of submicron carbon black particles (average particle size about 500 Angstroms) was added to the fuel oil while it was being vigorously stirred. As the mixture was being stirred, 100 grams of finely divided bituminous coal and 100 grams of finely divided newsprint—each having all particles less than ⅛ inch in size—was added. Vigorous stirring was next continued for at least 10 minutes, with the temperature being retained at a minimum of 140° F. The resulting hybrid slurry was placed in Pyrex jars, and stored in an oven at 140° F. to keep viscosity much lower than what it would be at room temperature so that the stability of the mixture would be more severely tested. At the end of 20 days no settling was observed, with little or no evidence of settling appearing after 30 days.

Energy present in the major component raw materials was measured using a standard method for measuring energy as BTUs/lb, and the following results were obtained:

The No. 6 fuel oil used had an API specific gravity of 11.5, a SSF viscosity at 122° F. of 254, a sulfur content of 0.85% by weight, an ash content of 0.034% by weight and a rating of about 17,000 BTUs/lb.

The finely ground bituminous coal had a rating of about 15,500 BTUs/lb.

The finely divided newsprint had a rating of about 7,400 BTUs/lb.

The stable hybrid fuel mixture had a rating of about 14,000 BTUs/lb.

EXAMPLE 12

A laboratory Waring Blendor was charged with 225 grams of No. 6 fuel oil at a temperature of 140° F., 25 grams of a 10% aqueous suspension of submicron carbon black particles (average particle size about 500 Angstroms) was added to the fuel oil while it was being vigorously stirred. As the mixture was being stirred, 100 grams of finely divided anthracite coal and 100 grams of dry cellulose microcrystals—all having particles less than ⅛ inch in size—was added. Vigorous stirring was next continued for at least 10 minutes, with the temperature being retained at a minimum of 140° F. The resulting hybrid slurry was placed in Pyrex jars, and stored in an oven at 140° F. to keep viscosity much lower than what it would be at room temperature so that the stability of the mixture would be more severely tested. At the end of 20 days no settling was observed, with little or no evidence of settling appearing after 30 days.

Energy present in the major component raw materials was measured using a standard method for measuring energy as BTUs/lb, and the following results were obtained:

The No. 6 fuel oil used had an API specific gravity of 11.5, a SSF viscosity at 122° F. of 254, a sulfur content of 0.85% by weight, an ash content of 0.034% by weight and a rating of about 17,000 BTUs/lb.

The finely ground anthracite coal had a rating of about 15,500 BTUs/lb.

The dry cellulose microcrystals had a rating of about 8,000 BTUs/lb.

The stable hybrid fuel mixture had a rating of about 16,200 BTUs/lb.

EXAMPLE 13

A laboratory Waring Blendor was charged with 225 grams of No. 6 fuel oil at a temperature of 140° F., 25 grams of a 10% aqueous suspension of submicron cellulose microcrystals (average particle size about 2500 Angstroms) was added to the fuel oil while it was being vigorously stirred. As the mixture was being stirred, 100 grams of finely divided anthracite coal and 100 grams of submicron carbon black—all having all particles less than ⅛ inch in size—was added. Vigorous stirring was next continued for at least 10 minutes, with the temperature being retained at a minimum of 140° F. The resulting hybrid slurry was placed in Pyrex jars, and stored in an oven at 140° F. to keep viscosity much lower than what it would be at room temperature so that the stability of the mixture would be more severly tested. At the end of 20 days no settling was observed, with little or no evidence of settling appearing after 30 days.

Energy present in the major component raw materials was measured using a standard method for measuring energy as BTUs/lb, and the following results were obtained:

The No. 6 fuel oil used had an API specific gravity of 11.5, a SSF viscosity at 122° F. of 254, a sulfur content of 0.85% by weight, an ash content of 0.034% by weight and a rating of about 17,000 BTUs/lb.

The finely ground anthracite coal had a rating of about 15,800 BTUs/lb.

The low-cost submicron carbon black had a rating of about 16,000 BTUs/lb.

The stable hybrid fuel mixture had a rating of about 16,500 BTUs/lb.

In all of the above examples, the temperature of the mixture in the disperser was maintained at 140° F., but stablized slurries have been prepared with the temperature being as low as about 100° F.; however, this entails a longer mixing time in order to get the desired stability. Accordingly, while temperatures may be as low as 100° F., it is preferred that temperatures of the mixture be maintained at about 140° F. during the preparation of the stabilized slurry. After the stabilized slurry has been prepared, the mixture is allowed to cool and is generally reheated prior to injection into a blast furnace. Temperatures higher than 140° F. can be used but are more expensive. Low viscosity fuels, such as waste crank case oil, can be used at room temperature.

The fuel oil used may be present in an amount from as low as 30% by weight of the final slurry to as much as 70% by weight of the final slurry; the greater amount of solid fuel being present, the cheaper the fuel and hence the more desirable the slurry. If less than 30 weight percent fuel oil is used, the slurry is too difficult to pump. The various liquid fuel oils useful in the present invention are, No. 6 fuel oil, waste crank case oil, and raw coal tar. Clearly, other fuel oils such as kerosene and the like may be used, but they are more expensive and hence undesirable.

The solid fuels useful in making up the stabilized slurries of the present invention may be selected from carbonaceous materials such as "run of the mine" coal, coke breeze, petroleum coke, asphalt, carbon black, finely ground newsprint, ground wood, sawdust, and colloidal organic polymer microcrystals.

With respect to the relationship between the mixing temperature and the mixing time, the higher the temperature, the lower the viscosity of the liquid fuel oil and hence the easier the mixing. Conversely, the lower the temperature, the higher the viscosity and the more difficult the mixing is and hence a longer mixing time is required. The balancing between longer mixing time and higher temperature is essentially a trade-off. The preferred temperature is about 140° F. to 160° F., but this clearly can be varied. Additionally, mixing times at the preferred temperatures can be held to between about 8 and 10 minutes, which is very desirable since it allows large batch quantities of the fuel slurry to be made rather rapidly. Also, it is understood that with larger volumes, of fuel, the mixing time may go up slightly; however, certainly the prior art mixing times of 5 to 6 hours will not be required for preparing the composite fuel of the present invention. Even with batches many times greater than those set forth in the examples, the longest mixing time envisioned is in the order of 20 minutes to one-half hour.

While there has been described herein a preferred method for preparing a stabilized slurry, it will be understood that other modifications and alterations may be made without departing from the true spirit and scope of the present invention. It is intended that all such modifications and alterations be covered in the appended claims.

What is claimed is:

1. The method of preparing a stabilized liquid fuel slurry comprising from about 30% to 70% liquid fuel oil, from about 25% to 65% solid fuel particles with sizes up to about ⅛ inch, from about 1% to 10% water and from about 0.5% to 10% insoluble suspending agent having submicron colloidal particle sizes and selected from the group consisting of carbon black, graphite and microcrystals isolated from linear organic polymers which comprises forming a suspension of the suspending agent in water, adding the suspension to the liquid fuel oil, subjecting the mixture to a high speed shearing operation, adding the solid fuel particles to the mixture while continuing the mixing operation for at least about 8 minutes to about 30 minutes.

2. The method as defined in claim 1 wherein the mixing operations are conducted at a temperature between about 100° and 160° F. for up to 10 minutes.

3. The method as defined in claim 1 wherein the suspending agent is carbon black.

4. The method as defined in claim 1 wherein the suspending agent consists of microcrystals isolated from cellulose.

5. The method as defined in claim 1 wherein the suspending agent consists of microcrystals isolated from a linear polyamide polymer.

6. The method as defined in claim 1 wherein the suspending agent consists of microcrystals isolated from a linear polyester polymer.

7. The method as defined in claim 1 wherein the suspending agent consists of microcrystals isolated from amylose.

8. A stabilized liquid fuel slurry comprising from about 30% to 70% liquid fuel oil, from about 25% to 65% solid fuel particles with sizes up to about $\frac{1}{8}$ inch, from about 1% to 10% water and from about 0.5% to 10% insoluble suspending agent having submicron colloidal particle sizes and selected from the group consisting of carbon black, graphite and microcrystals isolated from linear organic polymers.

9. A stabilized liquid fuel slurry as defined in claim 8 wherein the suspending agent is carbon black.

10. A stabilized liquid fuel slurry as defined in claim 8 wherein the suspending agent consists of microcrystals isolated from cellulose.

11. A stabilized liquid fuel slurry as defined in claim 8 wherein the suspending agent consists of microcrystals isolated from a liner polyamide polymer.

12. A stabilized liquid fuel slurry as defined in claim 8 wherein the suspending agent consists of microcrystals isolated from a linear polyester polymer.

13. A stabilized liquid fuel slurry as defined in claim 8 wherein the suspending agent consists of microcrystals isolated from amylose.

14. A stabilized liquid fuel slurry as defined in claim 8 wherein the liquid fuel oil is selected from the group consisting of petroleum oil and coal tar and the solid fuel is selected from the group consisting of coal, coal by-products, solid petroleum, residuum, ultra-fine newsprint, sawdust, ground wood and clean organic wastes.

* * * * *